US006019937A

United States Patent [19]

Shivanath et al.

[11] Patent Number: 6,019,937

[45] Date of Patent: Feb. 1, 2000

[54] PRESS AND SINTER PROCESS FOR HIGH DENSITY COMPONENTS

[75] Inventors: Rohith Shivanath, Toronto; Karol Kucharski, Burlington; Peter Jones, Toronto, all of Canada

[73] Assignee: Stackpole Limited, Mississauga, Canada

[21] Appl. No.: 09/200,480

[22] Filed: Nov. 27, 1998

[51] Int. Cl.[7] ..... B22F 3/00

[52] U.S. Cl. ..... 419/14; 419/25; 419/36; 419/38; 419/54; 419/55

[58] Field of Search ..... 419/11, 14, 25, 419/36, 38, 54, 55

[56] References Cited

U.S. PATENT DOCUMENTS

| | | | |
|---|---|---|---|
| 2,372,203 | 3/1945 | Hensel et al. . | |
| 3,859,085 | 1/1975 | Kimura et al. . | |
| 4,011,108 | 3/1977 | Hellman et al. . | |
| 4,711,823 | 12/1987 | Shiina | 428/547 |
| 5,516,483 | 5/1996 | Shivanath et al. | 419/14 |
| 5,552,109 | 9/1996 | Shivanath et al. | 419/53 |
| 5,603,072 | 2/1997 | Kouno et al. | 419/25 |
| 5,641,922 | 6/1997 | Shivanath et al. | 75/231 |
| 5,682,588 | 10/1997 | Tsutsui et al. | 419/11 |

*Primary Examiner*—Ngoclan Mai
*Attorney, Agent, or Firm*—Eugene J.A. Gierczak

[57] ABSTRACT

A process of forming a sintered article of powder metal comprising blending graphite, Si carbide and lubricant, with pre-alloyed iron base powder; pressing said blended mixture to a shaped article; sintering said article in a reduced atmosphere; forced cooling said sintered article.

17 Claims, 5 Drawing Sheets

Composition: 0.85%Mo, 0.4%Si, 1.35%C

Composition: 0.85%Mo, 0.4%Si, 1.35%C

PRESS AND SINTER PROCESS FOR HIGH DENSITY COMPONENTS

FIELD OF INVENTION

This invention relates generally to a process of forming a sintered article of powder metal by using graphite, silicon carbide and pre-alloyed iron base powder and particularly relates to a method and apparatus of spheroidizing following sintering by forced gas cooling from approximately 1000° C. by fan cooling.

BACKGROUND ART

Powder metal technology is well known to the persons skilled in the art and generally comprises the formation of metal powders which are compacted and then subjected to an elevated temperature so as to produce a sintered article.

Typically the percentage of carbon steel lies in the range of up to 0.8% C. Ultra high carbon steels generally speaking have carbon contents between 0.8% to 2.0% carbon.

It is known that tensile ductility decreases with an increase in carbon content and accordingly ultra high carbon steels have historically been considered too brittle to be widely utilized. However, the strengthening effect of carbon in steels is well understood.

Ultra high carbon steels have been produced as disclosed in U.S. Pat. No. 3,951,697 as well as in the article by D. R. Lesver, CKSYNA. Goldberg, J. Wadsworth and OD SHERBY, entitled "The Case for Ultra High Carbon Steels As Structural Materials" appearing in the Journal of Minerals, Metals and Materials St., August 1993.

Generally speaking the brittleness of such high carbon steels results from carbides which precipitate during the austentite to ferrite transformation during cooling. Moreover the reference to spheroidization refers to any thermo mechanical process that produces a rounded or globular form of carbide. Spheroidization is the process of heat treatment that changes embrittling grain boundary carbide and other angular carbides into rounded or globular form. In the prior art, the spheroidization process was time consuming and uneconomical as the carbides transform to a rounded form only very slowly. Typically spherodization requires long soak times of several hours at temperature. Mechanical working at elevated temperature has been used to speed up the spherodization process. However this adds costs and is only possible for relatively simple shapes.

The applicant herein has improved the prior art process of producing sintered metal articles having relatively high densities that include heat treatment steps which rapidly spherodize embrittling carbides. For example, applicant obtained U.S. Pat. No. 5,516,483 which relates to a process of forming a sintered article of powder metal comprising blending carbon and ferro alloys, lubricant with iron powder then high temperature sintering the article in a reducing atmosphere then spherodizing the sintered ultra high carbon steel. The use of silicon is disclosed but added as a ferro alloy namely ferro silicon to the iron powder.

Moreover applicant has obtained U.S. Pat. No. 5,552,109 which relates to a high density sintered alloy and spheroidization method utilizing pre-alloyed powders with for example 0.85% Mo in the pre-alloyed form blended with graphite and lubricant. U. S. Pat. No. 5,552,109 exhibits excellent results utilizing a spheroidization method where cooling may occur by oil quenching.

It is an object of this invention to provide an improved powder metal method whereby high density products are produced by spheroidizing with the rapid cooling utilizing a fan in a reducing or neutral atmosphere.

Although U.S. Pat. No. 5,516,483 taught the use of silicon such silicon was added in the form of ferro alloy namely ferro silicon. Generally speaking graphitization elements such as nickel and silicon (other than as trace elements) are to be avoided as taught in U.S. Pat. No. 5,641,922. Moreover if silicon is added as elemental silicon it tends to oxidize which is detrimental to the sintered powder metal article in both fatigue or endurance properties.

Silicon has been added to copper based sintering as shown in U.S. Pat. No. 2,372,203 as well as for cutting tools as shown in U.S. Pat. No. 4,011,108 and also in aluminium alloys as taught by U.S. Pat. No. 4,711,823.

It is a further object of this invention to provide simplified apparatus and method for producing sintered powder metal articles.

DISCLOSURE OF INVENTION

An aspect of this invention relates to a process of forming a sintered article of powder metal comprising blending graphite, Si carbide, and lubricant with pre-alloyed iron based powder; pressing said blended mixture to a shaped article; sintering said article in a reduced atmosphere; force gas cooling said sintered article. Silicon inhibits the formation of coarse blocky carbides and therefore permits a slower cooling rate to be utilized, which in turn results in less part distortion and simplified part handling during processing.

Another aspect of the invention relates to a process of sintering articles of powder metal comprising blending graphite, Si carbide and lubricant with pre-alloyed iron base powder; pressing said blended mixture to a shaped article; preheating said pressed article to a temperature between 600° C. and 700° C.; sintering said article in a furnace in a reducing atmosphere to a temperature between 1250° C. and 1350°; transferring said sintered article from said furnace to a region at a temperature of approximately 980° C.; rapidly forced gas cooling said sintered article from 980° C. to approximately 300° C. to 400° C. in nitrogen and further cooling to room temperature; reheating said article in a furnace to approximately 850° C. and holding the temperature of approximately 850° C. for up to two hours; slow cooling said article to room temperature. In one aspect the pressed article is placed on a tray for the preheating, sintering, transferring, rapidly forced gas cooling, cooling to room temperature steps referred to above, and then the article is separated from the tray prior to reheating said article in said furnace.

It is another aspect of this invention to provide an apparatus for producing sintered articles of powder metal comprising means for blending a mixture of graphite, Si carbide, lubricant and pre-alloyed iron base powder; means for compacting said blended mixture to a shaped article; means for preheating said shaped article to a temperature between 600° C. and 700° C.; a furnace for sintering said preheated article at a sintering temperature between 1250° C. and 1350° C. in a reducing atmosphere; means for transferring said sintered article to a transfer zone at approximately 980° C.; forced gas means for rapidly cooling said sintered article to approximately 300° C.; means to cool to room temperature; means to reheat said article to approximately 850° C. so as to slowly cool said article to room temperature.

Another aspect of this invention relates to a process of sintering articles of powder metal comprising blending graphite, Si Carbide and lubricant with pre-alloyed iron base powder, pressing said blended mixture to a shaped article;

preheating said pressed article to a temperature between 600° C. and 700° C.; sintering said article in a furnace in a reducing atmosphere to a temperature between 1250° C. and 1350° C.; transferring said sintered article from said furnace to a region to slow cool said article to room temperature; reheating said article in another furnace to approximately 980° C. and holding the temperature of approximately 980° C. for up to one hour; rapidly forced gas cooling said sintered article from 980° C. to approximately 300° C. to 400° C. in nitrogen; then reheating said article in said other furnace to approximately 850° C. and holding the temperature of approximately 850° C. for up to two hours; and slow cooling said article to room temperature. In yet another aspect the pressed article is placed on a tray for the preheating, sintering, cooling to room temperature steps referred to above; and then the article is separated from the tray prior to reheating said article in said other furnace.

Alternatively, the sintering furnace and other furnace can be linked with automated tray removal means being used.

Another aspect of this invention relates to apparatus for producing sintered articles of powder metal comprising means for blending a mixture of graphite, Si Carbide, lubricant and pre-alloyed iron base powder; means for compacting said blended mixture to a shaped article; means for preheating said shaped article to a temperature between 600° C. and 700° C.; furnace for sintering said preheated article at a sintering temperature between 1250° C. and 1350° C. in a reducing atmosphere; means for transferring said sintered article to a region to cool said article to room temperature; means for reheating said article in another furnace to approximately 980° C.; forced gas means for rapidly cooling said sintered article to approximately 300° C. to 400° C.; means for reheating said sintered article to approximately 850° C. so as to slowly cool said article to room temperature.

BEST MODE FOR CARRYING OUT THE INVENTION

Figure 1:
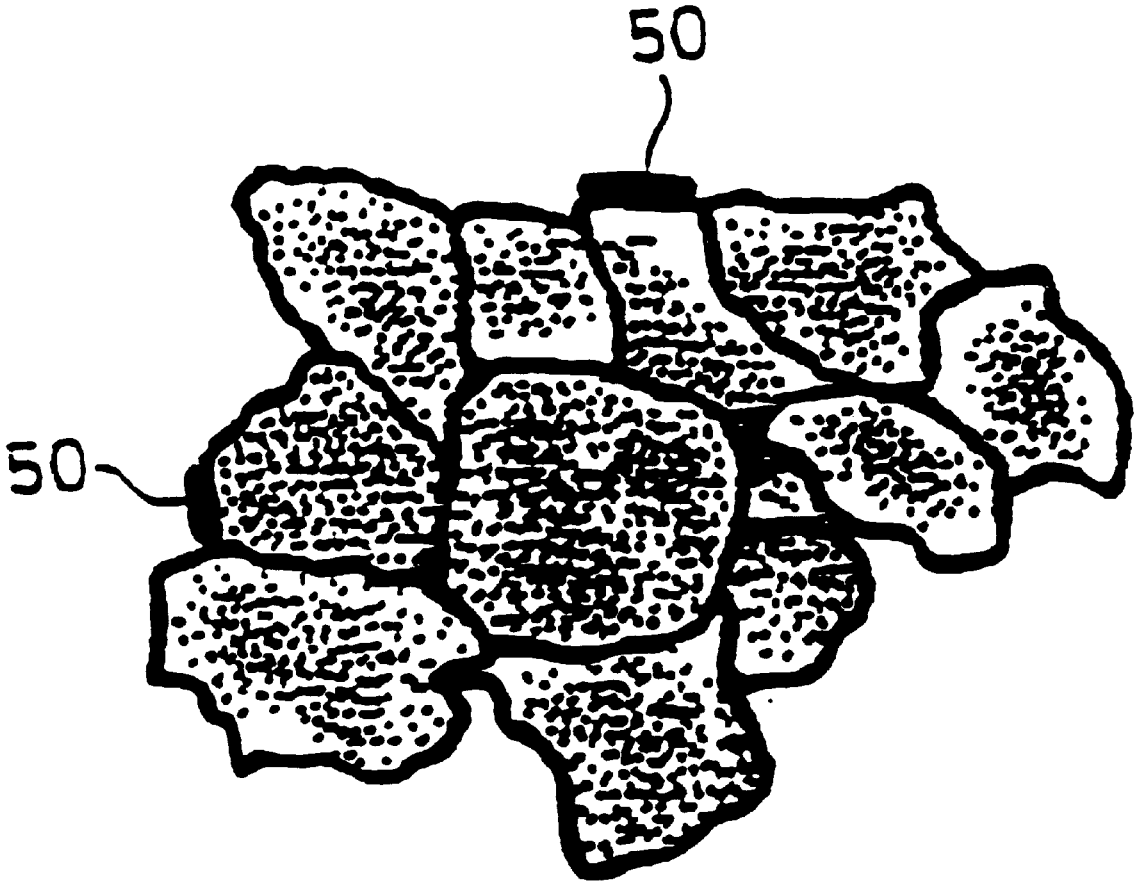
FIG. 1 is a sketch of grain boundary carbides in an as sintered article.

In the description which follows, like parts are marked throughout the specification and the drawings with the same respective reference numerals. The drawings are not necessarily to scale and in some instances proportions may have been exaggerated in order to more clearly depict certain features of the invention.

The invention disclosed herein utilizes high temperature sintering of 1250° C. to 1350° C. in a reducing atmosphere of for example hydrogen, hydrogen/nitrogen or in vacuum. Moreover, the reducing atmosphere in combination with the high sintering temperature reduces or cleans off the surface oxides allowing the particles to form good bonds and the compacted article to develop appropriate strength.

The lubricant is added in the manner well known to those persons skilled in the art so as to assist in the binding of the powder as well as assist in the ejection of the powder after pressing. An example of a clean burning lubricant which can be used is ethylene bistearamide. The articles are formed by pressing the mixture into shape by utilizing the appropriate pressure of for example 25 to 50 tonnes per square inch.

Pre-alloyed powders as used herein, consists of a metallic powder comprised of two or more elements which are alloyed in the powder manufacturing process, and in which the particles are the same nominal composition throughout.

The method to be described herein can be adapted to produce a high density grade powder metal sintered product having an ultra high carbon content with the following composition:

(a) 0.2 to 0.6% weight Si (b) 0.8 to 2.0% weight C (c) 0.5 to 3.0% Mo (d) remainder being iron and unavoidable impurities.

The silicon is added as silicon carbide. For example, the silicon carbide may be added in a 500 mesh particle size. However, other particle sizes can be used depending on cost, availability, and sintering characteristics required. The silicon carbide may be added in its usual black form although it may also be added in its green form which tends to be slightly more expensive.

The silicon carbide is added to the lubricant, graphite, and the pre-alloyed powder.

The mixed powder may be binder treated by using a binder treatment such as available from Hoeganaes under the trademark AncorBond or from QMP under the trademark Flomet. The use of a binder treatment tends to improve the flow characteristics of the premixed powders and minimize dusting, as well as enhance the goals of statistical process control by eliminating inherent segregation of mixed powder that results from moving and handling. Such binder treatments can be applied to premixed powders generally without altering the composition of the mix.

Particularly good results have been achieved by utilizing a pre-alloyed iron based powder of iron with a 0.85% molybdenum in the pre-alloyed form such as available from QMP under the designation AT 4401 or from Hoeganaes under the designation 85 HP. QMP AT 4401 has the following quoted physical and chemical properties:

| | |
|---|---|
| Apparent density | 2.92 g/cm$^3$ |
| Flow | 26 seconds/50 g |
| Chemical Analysis: | |
| C | 0.003% |
| O | 0.08% |
| S | 0.007% |
| P | 0.01% |
| Mn | 0.15% |
| Mo | 0.85% |
| Ni | 0.07% |
| Si | 0.003% |
| Cr | 0.05% |
| Cu | 0.02% |
| Fe | greater than 98%. |

The commercially available pre-alloy referred to above consists of 0.85% molybdenum pre-alloyed with iron and unavoidable impurities.

The mixture of silicon carbide, lubricant, graphite and pre-alloyed powder containing molybdenum is then blended and compacted by conventional pressing means to a minimum of 6.8 g/cc, so as to present a "green compact".

Figure 2:
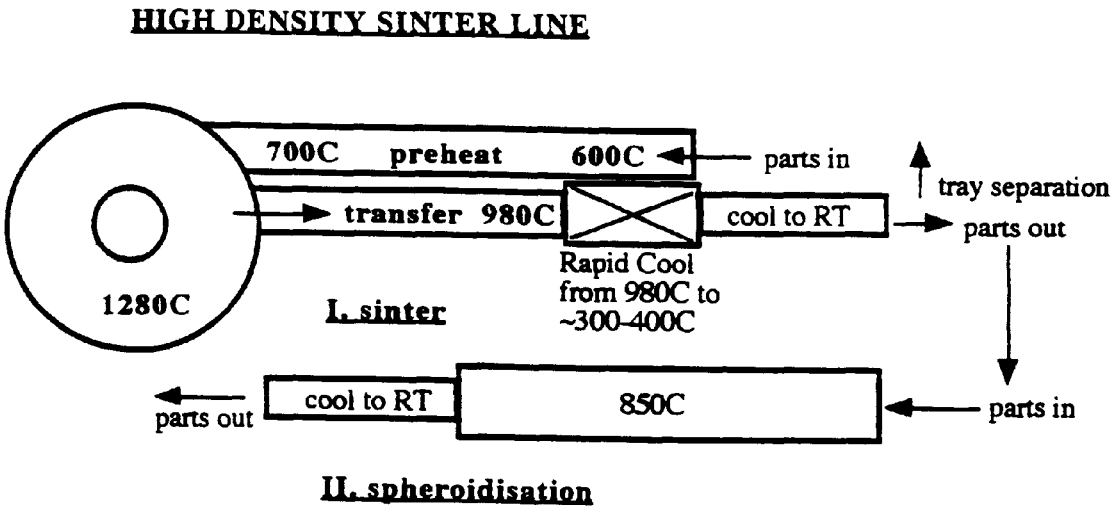
FIG. 2 is a schematic view of the sintered process and apparatus of one embodiment as described herein.

The compacted sintered article may then be placed in a preheat zone as shown in FIG. 2 which for example can be at a temperature of between 600° C. to 700° C. The compacts may be placed on a ceramic tray or supports (not shown) which then travel along the preheat zone as shown in FIG. 2 as for example on a conveyor system. The preheated compacts may then enter a sintering furnace. In the embodiment shown in FIG. 2 the green compact parts travel along the preheat zone initially and enter the furnace where the parts are sintered at a temperature between 1250° C. and 1350° C. The embodiment shown in FIG. 2 shows sintering at 1280° C. The sintered article may then be moved to a transfer zone in FIG. 2 which consists for example of another conveyor belt whereby the sintered parts on the ceramic supports travel along the conveyor system in the transfer zone so as to cool to a temperature of approximately 980° C.

Thereafter the transferred sintered articles at approximately 980° C. enter a rapid cool zone which consists of an enclosure having another conveyor system travelling there through. The sintered parts are rapidly cooled from approximately 980° C. to between 300° C. and 400° C. by means of fan cooling sometimes referred to as forced gas cooling. However, such cooling occurs in a nitrogen atmosphere so as to prevent oxidization. The rapid cool chamber is isolated by sealing doors so as to prevent the dissipation of nitrogen to the surrounding atmosphere. Parts subsequently travel through a cooling zone to reach room temperature.

Once the cooled sintered article exits from the cooling chamber or zone, the supports or ceramic trays may be separated by any number of means including a robot.

The as sintered and slow cooled sintered ultra high carbon steel article produced in accordance with the method described herein exhibits a high density of at least 7.6 g/cc and typically 7.7 g/cc although the article will tend to be brittle for the reasons described above. In particular, the brittleness occurs due to the grain boundary carbides 50 which are formed as shown in FIG. 1. The grain boundary carbides 50 will precipitate during the austentite to ferrite transformation during cooling.

Spherodization is the process of heat treatment that changes embrittling grain boundary carbides and other angular carbides into rounded or globular form.

Spheroidization of the part follows the sintering and rapid cool stage so that the spheroidized product exhibits:

(a) high density (of for example 7.75 g/cc)

(b) well rounded residual porosity (c) a homogeneous structure (d) finally dispersed spherodized carbides and (e) a product that is similar to wrought steel in its property.

Figure 3:
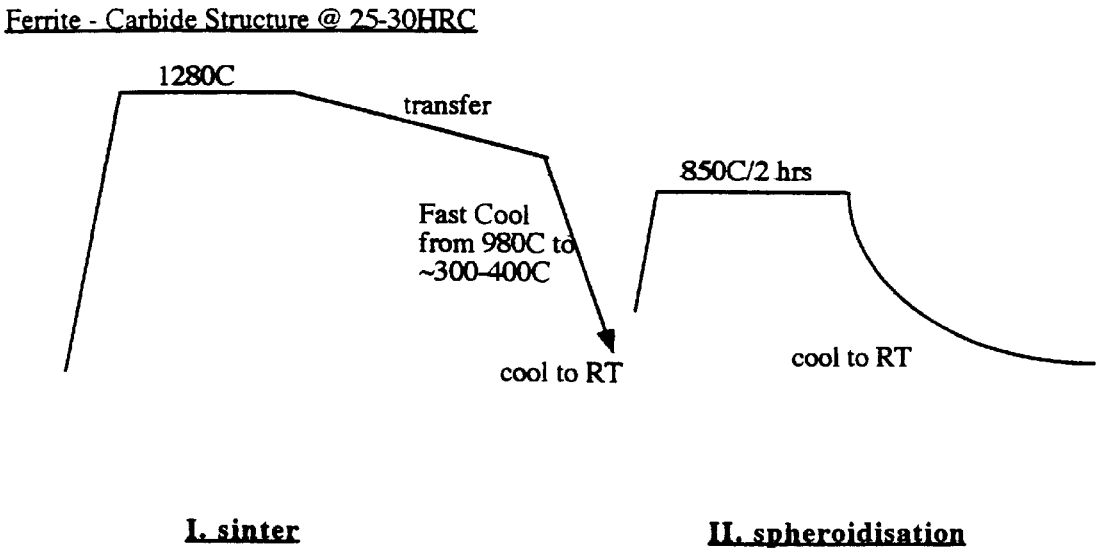
FIG. 3 is a schematic diagram of one embodiment of the heat treatment and cooling process shown in FIG. 2.

The method for spherodization as described herein comprises the high density sintered components produced as described above which are rapidly cooled from the austenitic phase in neutral atmospheres such as nitrogen so that precipitation of embrittling grain boundary carbides is minimized. Rapid cooling (i.e. 980° C. to 300–400° C.) results in the formation of a meta stable micro structure which may be subsequently spheroidized relatively easily. Subsequent heat treatment of the part involves heating to 850° C. for two hours in a furnace and then cooled to room temperature as shown in FIG. 3 resulting in relatively rapid spherodization of carbides. A good balance of high strength and ductility is obtained. For example, a sintered article produced in accordance with the process shown in FIGS. 2 and 3 and having a final composition of 0.85% Mo, 0.4% Si, 1.35% C by weight with the remainder being iron and unavoidable impurities exhibited:

UTS: 960 MPa

YS: 725 MPa

HRC: 25

%E: 4.

In the embodiment disclosed in FIGS. 2 and 3 the pressed green articles or parts are placed on a tray or supports which will then travel through the preheat zone so as to preheat the green parts to a temperature between 600 to 700° C. The green parts may travel through the preheat zone by means of a conveyor system so as to enter the furnace for sintering at a temperature of 1280° C. The furnace shown in FIG. 2 is circular so as to provide a rotary path for the parts to be sintered on the supports travelling through the rotary furnace. Once sintered the parts are then removed from the rotary furnace so as to travel through a transfer zone at a temperature of approximately 980° C. The transfer zone may also comprise a conveyor belt moving away from the rotary furnace. The sintered parts then enter a rapid cool chamber by way of a conveyor system so as to rapidly cool the sintered parts from approximately 980° C. to between 300 to 400° C. As stated the rapid cool chamber is isolated by sealed doors so as to prevent the dissipation of nitrogen to the surrounding atmosphere. The parts then subsequently travel again by means of a conveyor system through a cooling zone to reach room temperature. Thereafter tray separation occurs whereby the sintered part is removed from the tray and then placed in another furnace so as to heat the parts to 850° C. and hold the parts at that temperature for about two hours. The parts then exit the second furnace and are cooled to room temperature. Although FIG. 2 shows that the first and second furnace are separated such furnaces may be linked with automated tray removal means being used such as a robot or the like.

Figure 4:
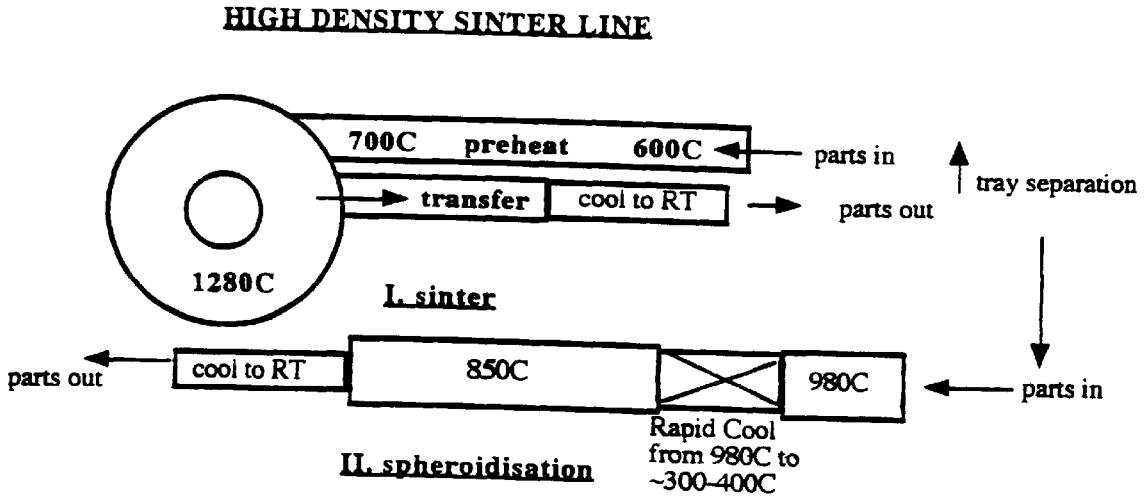
FIG. 4 is a schematic view of the sintering process and apparatus of another embodiment as described herein.
Figure 5:
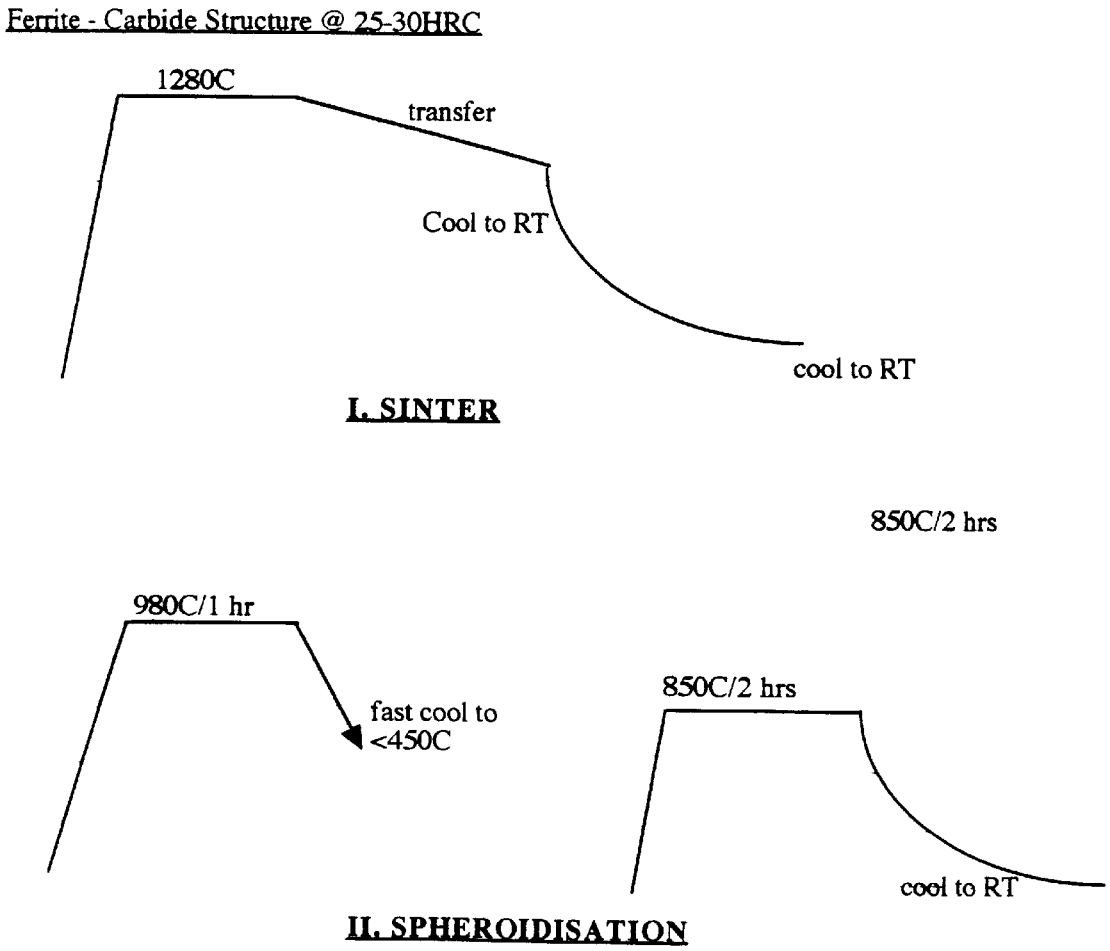
FIG. 5 is a schematic diagram of another embodiment of the heat treatment and cooling process as shown in FIG. 4.

In the embodiment shown in FIGS. 4 and 5 the compacted sintered article is also placed in a preheat zone as shown in FIG. 4 at for example at a temperature between 600 to 700° C. The compacts may be placed on a ceramic tray or supports (not shown) which then travel along for example a conveyor system along the preheat zone as shown in FIG. 4. The preheat compacts also enter the sintering furnace and are sintered at a temperature between 1250° C. and 1350° C. The embodiment shown in FIG. 4 shows sintering at 1280° C. The sintering article is then moved to a transfer zone in FIG. 4 which may also consist of another conveyor belt whereby the sintered parts on the ceramic supports travel along the conveyor system in the transfer zone so as to cool the part or article to room temperature. Thereafter the sintered parts are separated from the supports and enter a second furnace so as to reheat the sintered parts to approximately 980° C. and hold the temperature of approximately 980° C. for up to one hour in the first zone of the second furnace. In the embodiment shown in FIG. 4 the sintered parts may enter the second furnace on a conventional wire mesh belt. Thereafter the parts are rapidly forced gas cooled from approximately 980° C. to approximately 300 to 400° C. in nitrogen. This cooling occurs in a second zone of the second furnace in a rapid cool zone or chamber of the second furnace. The rapid cool zone or chamber is isolated from the remainder of the second furnace by sealing doors. The articles or parts are then reheated in a third zone of the second furnace to approximately 850° C. The temperature of approximately 850° C. is held for up to two hours and thereafter the articles or parts exit the furnace for slow cooling the article to room temperature.

Alternatively, the first and second furnaces shown in FIGS. 4 may be linked with automated tray removal means being used.

It is believed that the embodiment shown in FIGS. 2 and 3 is more economical than the embodiment shown in FIGS. 4 and 5 since reheating of the parts to 980° C. is not required in FIG. 2 while it is in FIG. 4.

When reheating the sintered article to 850° C. and holding the temperature for example two hours, the temperature and time is selected so as to obtain a sintered article having the desired properties. For example, the "hold time" is selected for desired hardness, i.e. the longer the time the softer the metal.

Moreover by rapidly cooling by means of forced cooling a number of improvements are exhibited over oil quenching, namely:

(a) spherodization is simpler (b) separation of the sintered part from the tray is easier and can be accomplished by use of a robot at a lower temperature vis-a-vis oil quenching;

(c) structure and apparatus is less complicated and accordingly less expensive than utilizing oil quenching equipment;

(d) the use of rapid cooling by fans reduces the chance of distortion of the sintered powder metal article which may occur when oil quenching.

(e) parts are cleaner and do not require washing or drying and therefore exhibit an environmentally cleaner environment.

By way of example, the rapid cooling described above occurs at a rate of 50° C. per minute; however other cooling rates may be used.

Particularly good results can be achieved by utilizing silicon carbide with pre-alloyed molybdenum powder whereby the finished product as the following composition, namely:

(a) 0.85% Mo (b) 1.35% weight C (c) 0.4% weight Si.

By utilizing air or fan cooling one can achieve powder articles having better size control with a relatively simpler process.

Moreover densities of at least 7.6 g/cc can be achieved; and typically greater than 7.7 g/cc.

Various embodiments of the invention have now been described in detail. Since changes in and/or additions to the above-described best mode may be made without departing from the nature, spirit or scope of the invention, the invention is not to be limited to said details.

Although the preferred embodiment as well as the operation and use have been specifically described in relation to the drawings, it should be understood that variations in the preferred embodiment could be achieved by a person skilled in the trade without departing from the spirit of the invention as claimed herein.

We claim:

1. A process of forming a sintered article of powder metal comprising:

(a) blending (i) graphite (ii) Si carbide, and (iii) lubricant, with (iv) pre-alloyed iron base powder (b) pressing said blended mixture to a shaped article;

(c) sintering said article in a reduced atmosphere;

(d) forced cooling said sintered article.

2. A process as claimed in claim 1 wherein said cooled sintered article comprises between:

(a) 0.2 to 0.6% weight Si (b) 0.8 to 2.0% weight C (c) 0.5 to 3.0% Mo remainder being iron and unavoidable impurities.

3. A process as claimed in claim 2 wherein said sintering occurs at temperature between 1250° C. to 1350° C.

4. A process as claimed in claim 3 wherein said sintered article is cooled by nitrogen at a rate of approximately 50° C. per minute.

5. A process as claimed in claim 4 wherein said sintered article is rapidly cooled to approximately 300° C. and then cooled to room temperature.

6. A process as claimed in claim 5 wherein said sintered article is then reheated to a temperature of approximately 850° C. and cooled to room temperature.

7. A process as claimed in claim 6 wherein said sintered article is cooled from approximately 850° C. to room temperature in approximately two hours.

8. A process as claimed in claim 4 wherein said sintered article is cooled to room temperature after sintering.

9. A process as claimed in claim 8 wherein said sintered article is reheated from room temperature to a temperature of approximately 980° C. for one hour.

10. A process as claimed in claim 9 wherein said sintered article is then rapidly cooled from 980° C. to approximately 300 to 400° C.

11. A process as claimed in claim 10 wherein said article at 300 to 400° C. is reheated to 850° C. for approximately two hours, and then cooled to room temperature.

12. A process of sintering articles of powder metal comprising:

(a) blending (i) graphite (ii) Si carbide and (ii) lubricant with (iv) pre-alloyed iron base powder;

(b) pressing said blended mixture to a shaped article;

(c) preheating said pressed article to a temperature between 600° C. and 700° C.;

(d) sintering said article in a furnace in a reducing atmosphere to a temperature between 1250° C. and 1350°;

(e) transferring said sintered article from said furnace to a region at a temperature of approximately 980° C.;

(f) rapidly fan cooling said sintered article from 980° C. to approximately 300° C. in nitrogen, then cooling to room temperature;

(g) reheating said article to approximately 850° C. and holding said temperature for a selected time for desired hardness;

(h) slow fan cooling said article to room temperature.

13. A process as claimed in claim 12 wherein said cooled sintered article comprises between:

(a) 0.2 to 0.6% weight Si (b) 0.8 to 2.0% weight C (c) 0.5 to 3.0% weight Mo remainder being iron and unavoidable impurities.

14. A process as claimed in claim 9 wherein said cooled sintered article comprises:

(a) 0.4% weight Si (b) 1.35% weight C (c) 0.85% weight Mo (d) remainder Fe and unavoidable impurities.

15. The process as claimed in claim 11 wherein said article is slow cooled from 850° C. to a room temperature in approximately two hours so as produce an article exhibiting a rockwall hardness between 90 B and 45 C hardness.

16. A process as claimed in claim 11 wherein said article is slow cooled from 850° C. to room temperature in approximately two hours so as to produce an article exhibiting a ferrite carbide structure of 25 to 30 HRC.

17. A process of sintering articles of powder metal comprising:

(a) blending
  (i) graphite
  (ii) Si carbide and
  (ii) lubricant with
  (iv) pre-alloyed iron base powder;

(b) pressing said blended mixture to a shaped article (c) preheating said pressed article to a temperature between 600° C. and 700° C.;

(d) sintering said article in a furnace in a reducing atmosphere to a temperature between 1250° C. and 1350°;

(e) transferring said sintered article from said furnace so as to cool said sintered article to room temperature (f) reheating said sintered article to a temperature of approximately 980° C. and holding said temperature for approximately one hour;

(g) rapidly fan cooling sintering article from 980° C. to approximately 300 to 400° C. in nitrogen;

(h) reheating said article to approximately 850° C. and holding said temperature for selected time for desired hardness;

(i) slow cooling said article to room temperature.

* * * * *